United States Patent [19]

Gannett

[11] 3,953,677

[45] Apr. 27, 1976

[54] KEY SIGNALING SYSTEM WITH MULTIPLE PULSE GENERATORS

[75] Inventor: Danforth K. Gannett, Mountain Lakes, N.J.

[73] Assignee: Bell Telephone Laboratories, Incorporated, Murray Hill, N.J.

[22] Filed: May 10, 1945

[21] Appl. No.: 592,964

[52] U.S. Cl. ..... 179/1.5 R

[51] Int. Cl.[2] ..... H04K 1/02

[58] Field of Search ..... 179/1.5, 100.2, 1.5 R, 179/15.6 PC

[56] References Cited

UNITED STATES PATENTS

| | | | |
|---|---|---|---|
| 1,598,673 | 9/1936 | Blackwell | 179/1.5 |
| 2,098,956 | 11/1937 | Dudley | 179/1.5 |
| 2,262,838 | 11/1941 | Deloraine | 179/1.5 |
| 2,406,347 | 8/1946 | Buhrendorf | 179/1.5 |
| 2,406,350 | 8/1946 | Harrison | 179/1.5 |
| 2,406,881 | 9/1946 | Young, Jr. | 179/1.5 |
| 2,419,568 | 4/1947 | Labin | 179/1.5 X |

*Primary Examiner*—Richard A. Farley
*Attorney, Agent, or Firm*—H. A. Burgess

EXEMPLARY CLAIM

1. In a secret signaling system, means at a station for providing a plurality of different keys for use one at a time for enciphering signals to be sent from said station, means at said station when transmitting for sending a concomitant indication identifying the particular key that is in use in transmitting, means at a station when receiving secret signals and key indications from another station for providing a plurality of different keys which are duplicates of those provided at the distant sending station, means responsive to the received key indication for automatically selecting the appropriate key for deciphering the received secret signals, and means for deciphering said received secret signals by means of said selected key.

12 Claims, 2 Drawing Figures

Figure 1:
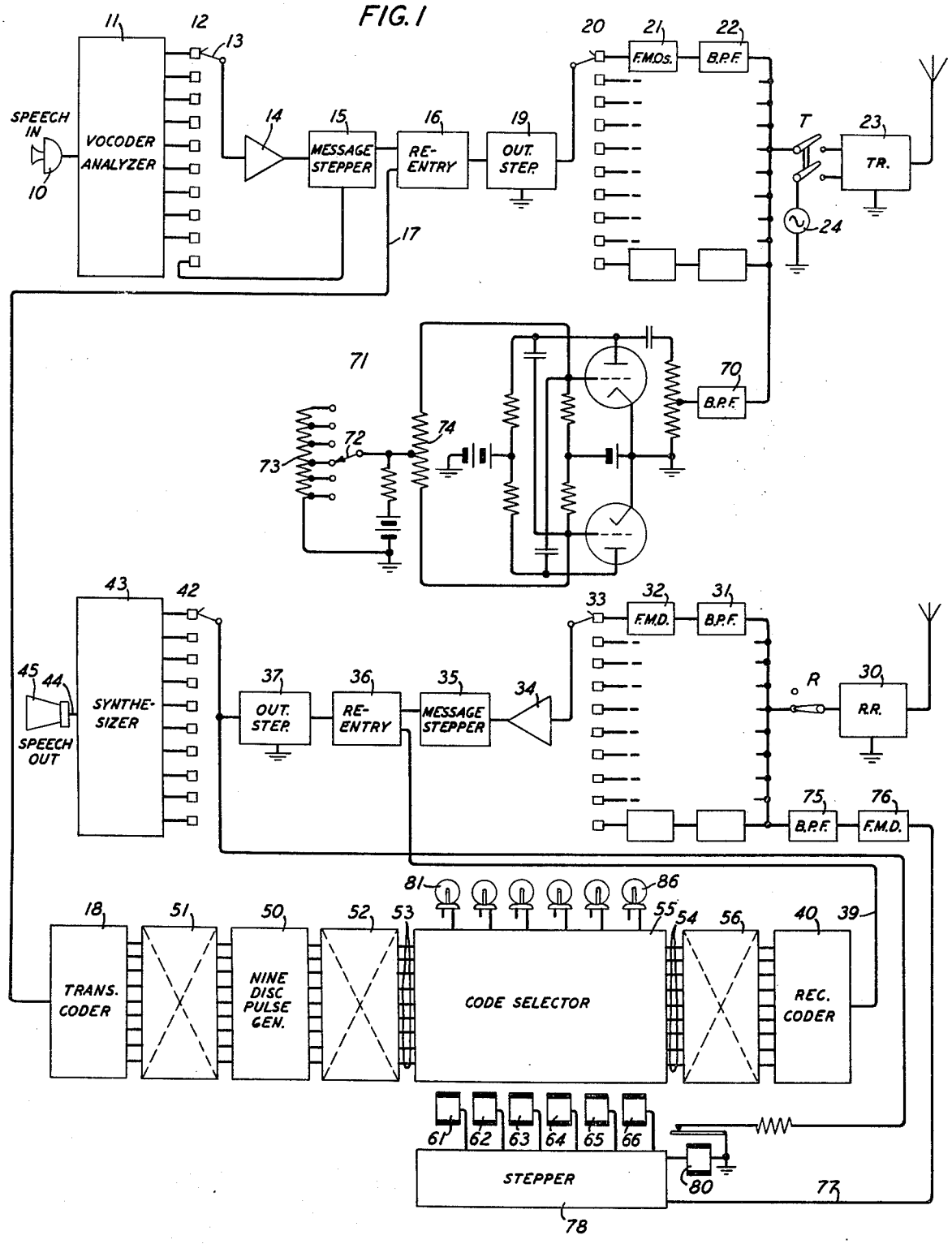

INVENTOR
D. K. GANNETT
BY
H. A. Burgess
ATTORNEY

KEY SIGNALING SYSTEM WITH MULTIPLE PULSE GENERATORS

The present invention relates to secret signaling in which the signals are enciphered by means of a secret key before sending and are deciphered by means of a duplicate key upon reception. In such systems, if a given station is to receive signals from different sending points using different keys, it is necessary for the receiving station to be able to select the proper key for the particular sending station that is to be received.

The general object of the invention is to give an indication to a receiving station of the key that is necessary to use for deciphering the incoming secret signals.

A further object is to provide for automatically supplying at the receiving point the proper key for deciphering the incoming signals.

Further and related objects will appear as the description proceeds.

In accordance with the specific embodiment of the invention to be disclosed hereinafter, a key identifying signal is sent out from a sending station along with the enciphered message. This identifying signal is such as will give an outsider no clue to the character of the enciphering used nor to the characteristics of the key in use. The key can be changed from time to time in accordance with a prearranged schedule so that unless one is in possession of this schedule, there is no ascertainable relation between the key and its identifying signal. When this identifying signal is received it is made to select automatically the key that is needed to decipher the incoming message.

One way of generating key currents at the various stations is to provide synchronously running impulse producing mechanisms and duplicate coding circuits for building up the key waves, starting with these impulses. In one specific arrangement the impulse producing mechanism may comprise a number of, such as nine, rotating members, each of which generates its own characteristic series of irregular pulses. The eventual key currents are, as stated, built up by combinations of, or under control of, the pulses from these several rotating members. If the connections between the rotating members and the coding circuit are varied, a different key results.

A feature of the invention comprises a switching circuit for changing these connections between the impulse producing members and the coding circuit in such manner so to produce a definite number of keys all differing markedly from each other, which keys are available for selection and use. In accordance with this feature of the invention nearly all possible permutations of the, in this case, nine connections can be realized by means of a single set of switches for interconnecting nine input terminals to nine output terminals, assuming patching connections to be made between the rotating members and input terminals and again between the output terminals and the coding circuit for variously changing the circuit connections at these two points.

By providing relays for operating these switches, the different keys in use for the day (or other stated period) can be selected under control of the key identification received from the distant station.

Figure 2:
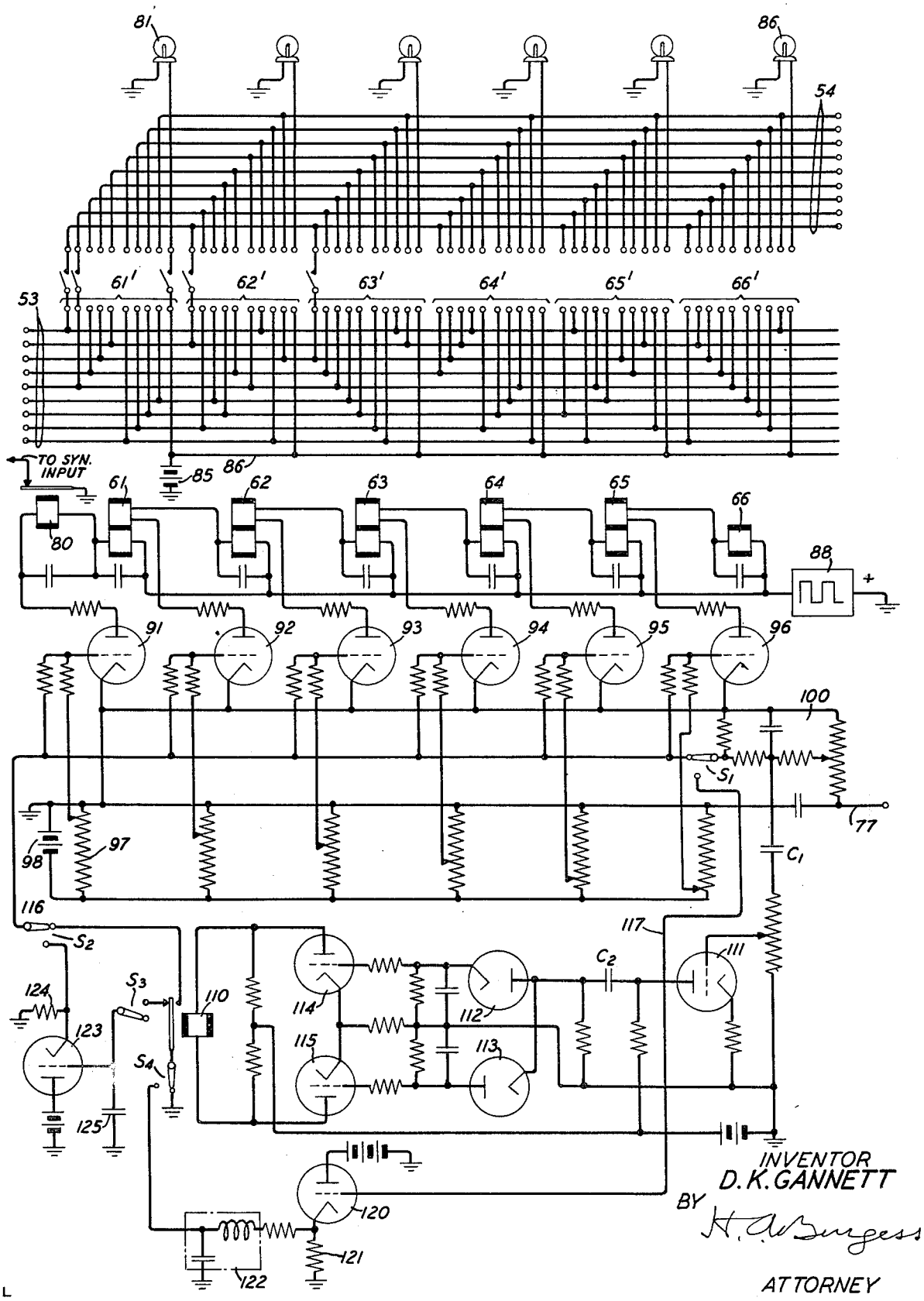

The nature of the invention together with its various features and objects will be more clearly understood from the following detailed description of the illustrative embodiment shown in the attached drawings in which:

FIG. 1 is an over-all block schematic diagram of a complete two-way station with automatic code selection in accordance with the invention; and FIG. 2 is a schematic circuit diagram of the automatic key selecting circuit in accordance with the invention.

Referring to FIG. 1, the transmitting and receiving circuits except for the key indicating and key selecting features may be of the type disclosed and claimed in R. L. Miller, Ser. No. 542,975, filed June 30, 1944 with a further exception as to the manner in which the key is produced. In the Miller application the key is shown as derived from a phonographic record while in the present disclosure the manner of generating the key is, except for the automatic key selecting feature, the same as that disclosed and claimed in my prior application, Ser. No. 555,913, filed Sept. 27, 1944.

As in the Miller disclosure, the input speech waves from the microphone 10 or other connecting line are first analyzed in the vocoder analyzer 11 to derive from them in a number of individual paths low frequency currents indicative of the energy variations occurring within different narrow frequency bands of the speech waves. Also a low frequency current is derived in the analyzer which is representative of the fundamental pitch of the speech waves and of the pitch variations with time. The subdivision into the various subbands may be carried as far as desired but for purposes of the present disclosure it will be assumed that there are eight individual circuits or paths for the speech defining currents and one for the pitch defining currents. These nine individual paths are individually connected to the segments of a distributor 12 which also has a tenth segment for use in providing a second or vernier pitch channel, all as disclosed in detail in the Miller application. While the distributor 12 is shown as comprising the brush 13 sweeping over stationary segments shown in a straight line, it is contemplated that in practice a multiple relay circuit would be used at this point as fully disclosed in the Miller application. The distributor samples the currents in the various vocoder channels in rapid succession, the sampling rate being, for example, 500 per second. The sampled pulses are amplified at 14 and impressed upon the message stepper 15, the details of which are fully disclosed in the Miller application. The output of the stepper 15 is connected to the reentry circuit 16 which has impressed upon it also key pulses coming in over lead 17 from the transmitting coder 18, to be referred to. The output of the reentry circuit 15 passes to the output stepper 19 and thence to the brush of the second distributor 20 which also may be a relay type of distributor as shown by Miller. The reentry 16 and output stepper 19 may also be of the types shown by Miller.

The output of the stepper 19 is distributed over, in this case, ten segments each leading to an individual frequency modulated oscillator 21 which, as in the Miller application, is assumed to include a holding circuit for maintaining the input voltage constant for slightly less than one rotational period of the distributor 20. The frequency modulated oscillator circuit 21 is thus caused to send out carrier current of a frequency definitely related to the amplitude of the pulse impressed upon it from the output stepper 19, this frequency, of course, varying as the amplitude of the impressed signal varies. The resulting modulated oscillations are passed through the respective channel band-pass filter 22. The output terminals of all of the channel band-pass filters 22 are connected in common through a push-to-talk switch T to the input of a radio transmitter 23 for transmission to the distant station. This key or switch T comprises two blades ganged together, the lower one of which supplies radio frequency carrier waves from source 24 to transmitter 23. Radio transmitter 23 does not emit unmodulated carrier waves so long as the switch T is open but carrier waves are supplied along with the signal waves whenever the switch T is closed. The switch T is normally open as shown and may be operated from a push-to-talk button on the talker's handset by means of relay circuits, not shown.

Referring to the receiving side of the system, waves received from a distant transmitter are picked up, amplified and demodulated in radio receiver 30 and are impressed through normally closed receiving switch R to the input terminals of the receiving band-pass filters 31 where they are separated into the various individual channel frequencies which then pass into the respective frequency modulation detectors 32. The demodulated signal currents are impressed upon segments of a rotating distributor 33 which, as in the case of distributors previously mentioned, may be of the relay type shown by Miller. The distributor samples the received signals in the various channels and applies them through an amplifier 34 to the input of message stepper 35 which is followed by reentry 36 and output stepper 37, these elements corresponding respectively with elements 14, 15, 16 and 19 previously referred to. Key waves are applied to the reentry 36 over lead 39 from the receiving coder 40 for deciphering the received enciphered signals so that the currents in the output of reentry 36 and also in the output of the stepper 37 will be deciphered signal pulses. These latter are distributed by means of distributor 42 to individual vocoder channels of the synthesizer 43 where they are used, as in the Miller disclosure, to reconstruct from local sources of energy speech waves corresponding to the original input speech waves at the distant station. These recovered speech waves are applied to an audio circuit 44 which leads to any suitable output circuit or line or to the receiver illustrated at 45.

The elements of the system thus far described, except for the switches T and R, are all in accordance with the Miller application disclosure and many details have been omitted from the figures as being unnecessary to an understanding of the present invention. The switches T and R have been added in the present case since it is assumed that the two-way operation of the circuit will be under control of a push-to-talk button as already stated. It will be understood that the timing of the various parts of the system are carried out under control of a single channel frequency oscillator as shown in the Miller application and that pulsing power supplies will be provided under control of this oscillator for the reentry and stepper circuits; also that the actuating currents for the various distributors will be derived from this oscillator and that the necessary time or phase displacements between the functionings of the different pieces of equipment will be provided as in the Miller disclosure.

Referring now more particularly to the improvement features provided in accordance with the invention, these have to do with the matter of providing the keys to be supplied over conductor 17 to transmitting reentry circuit 16 and over lead 39 to the receiving reentry 36.

The key is built up in the transmitting coder 18 or receiving coder 40 from prime pulses generated in the disc pulse generator 50 in the general manner disclosed in my prior application referred to. Considering first the transmitting coder 18, the nine output leads from the generator 50 are connected through a cross-connecting or patching panel 51 in which cross-connections between the incoming and outgoing nine leads may be made in any desired manner. The nine leads coming out of the panel 51 are then connected across into the transmitting coder 18 where the pulses on the various leads are built up into a succession of key pulses occuring at the rate of 500 per second as disclosed in my prior application referred to. These output pulses are then applied to outgoing lead 17.

In addition to the nine output leads extending to the left in the figure, the pulse generator 50 is also provided with nine output leads extending from the right, the pulses in these latter leads being duplicates of the pulses in the other nine output leads but having any desired time relation with respect thereto. Different time displacements between the two sets of pulses may be secured by mechanically shifting the pick-up devices serving the second group of leads relative to those serving the first group of output leads, it being understood that the respective pick-up devices on the same rotating member receive the same series of pulses with an intervening delay. One way in which this may be accomplished is disclosed in detail in an application of A. E. Melhose, Ser. No. 555,912, filed Sept. 27, 1944 and for purposes of the present disclosure it will be assumed that the pulse generator 50 is the same in construction and operation as that disclosed in FIG. 5 and following of the Melhose application.

The second set of output leads from generator 50 is connected through a cross-connecting panel 52 which may be similar to panel 51. The outgoing leads from this panel, identified as group 53 on the drawing, lead to the code selector 55 to be described more fully hereinafter. The group 54 of the nine output leads from the code selector 55 is connected through a cross-connection panel 56 and thence into the receiving coder 40 which is similar in construction and operation to the coder 18.

The code selector or key selector 55 is arranged to permute the group of output leads 54 with respect to the group of input leads 53 in any one of six different ways under control of the six selecting relays shown at 61 to 66. That is, relays 61 to 66 are operated one at a time and whenever one of these relays is operated it will shift nine armatures (shown in detail in FIG. 2) in the key selector 55 to provide an individual type of permutation between the input leads 53 and output leads 54. As stated, each relay provides a different permutation and, therefore, a different key in the output lead 39 of the coder 40.

It is contemplated that in a multistation network or system each station is to be provided with a pulse generator 50 which is identical at all stations and that all of these pulse generators are run in close synchronism with each other. This may be done by driving each machine from the standard frequency oscillator at the respective station. It will be assumed for purposes of the present disclosure that a maximum of six stations will be used in any given intercommunicating network although this figure is given as illustrative and not as limiting. Each of the stations will be arranged when transmitting to use a different code from all the others. These codes may be changed frequently, for example, daily in accordance with a prearranged schedule. On any one day the attendant will set up connections in panel 51 to determine the transmitting key for each station and, therefore, the cross-patching will be different for each station.

The transmitting side of each station comprises a station identifying circuit which is shown as connecting to the input side of the channel band-pass filter 70. This comprises a frequency modulation oscillator 71 which may be of the same type as that used at 21 in each of the channels but which sends out a constant frequency different for each station as determined by the setting of the switch 72 along the potentiometer 73. The oscillator 71 is illustrated as a two-tube multivibrator circuit of generally known type, the fundamental frequency of which is determined by the direct current voltage applied to its grids at the middle of the high resistor 74. By setting the slider 72 at any one of the six points indicated along resistor 73, any one of six different voltages may be applied. The oscillator is thus given any one of six different oscillation frequency adjustments. The switch 72 will be given a different setting at each of the six stations of the system. This constant frequency station identifying frequency is sent through band-pass filter 70 to the common output circuit of the channel filters 22 and out over the transmitter 23 to the distant stations.

The station identifying wave when received from a distant station in the receiving circuit 30 is selected by band-pass filter 75 and demodulated at 76 to recover an indication of the amount of direct current voltage that was impressed upon the station identifying oscillator in the distant station. Thus, there is produced in the conductor 77 a direct current voltage corresponding to the setting of the slider 72 of whatever station is being received at the moment. This voltage is applied to a stepper 78, to be described more in detail hereinafter, which causes one and one only of the six relays 61 to 66 to become actuated. This results in the application to the input of the receiving coder 40 of the same set of pulses as are impressed on the nine output conductors of the transmitting coder of the distant station, and therefore, in the production of an identical key in the output circuit 39. In order for this to occur, it is necessary that the proper patching has been made in the panels 52 and 56 for the particular day or other scheduled period.

A special relay 80 is provided in connection with the stepper 78 to be operated only when a station identifying voltage is present on conductor 77. This relay when not actuated short-circuits the output side of the output stepper 37 so as to prevent noise and key from being heard by the listening party when no station is transmitting.

Six station lamps are shown at 81 to 86 just above the code selector 55 for giving to the user a visual indication of the distant transmitting station which is talking. As will be described in connection with FIG. 2 these lamps are operated one at a time depending upon the individual relay 61 to 66 that is operated.

Referring to FIG. 2, the group of nine leads 53 is shown coming in from the left and is multipled to the armatures of the station selector relays 61 to 66. The front contacts of these relays are shown as multipled to the outgoing group of nine conductors 54. Each relay has ten armatures and when actuated closes all ten contacts. The first nine armatures and contacts connect the group of leads 53 in a particular permutation to the leads 54. The tenth armature connects battery 85 over bus conductor 86 and the tenth relay armature and contact to one side of the corresponding lamp 81 to 86, the opposite terminal of which is grounded. For simplicity of showing, not all of the relay armatures and front contacts have been drawn in but the terminals of each relay are indicated by the corresponding bracket and by the corresponding relay number primed.

The stepper circuit for individually operating the relays 61 to 66 comprises six gas-filled tubes 91 to 96 having their cathodes all connected to ground and having their plates individually connected through relay windings to the source of pulsing power 88 which supplies 500 pulses per second. The grids of these tubes are given progressively higher negative bias voltages by connecting them to different points along the resistors 97 which are shunted across biasing battery 98. The grids are also connected in parallel to the input conductor 77 through a filtering circuit 100 comprising series resistances and shunt capacitances. This filtering circuit suppresses transients and prevents false operation of the tubes and relays.

Assuming a relatively weak voltage on conductor 77 corresponding to the station whose switch is on the lowermost potentiometer terminal shown in FIG. 1, this voltage will cause only tube 91 to fire, this tube having the least negative bias of any of the tubes. The firing of this tube will cause the energization of relays 80 and 61. Relay 80 in operating moves the normal short-circuiting connection across the input of the synthesizer as shown in FIG. 1. Relay 61 in energizing attracts its armatures and closes the nine leads 53 through to the nine leads 54 in a certain permutation and also causes the lighting of lamp 81 from battery 85.

If the voltage coming in on conductor 77 is of the right value to fire the two tubes 91 and 92, relay 62 will be energized but relay 61 will not be energized because of the equal opposing effects of its two windings, one carrying the space current of tube 91 and the other carrying the space current of tube 92. (Relay 80 is of course energized as before). Similarly, if the first three tubes 91, 92 and 93 fire, the only selecting relay to be energized is relay 63. If all six tubes fire, relay 66 alone will respond. Each of the relays 61 to 66 and 80 is provided with a shunting condenser around its winding to prevent the relay armatures from chattering due to the pusling current from source 88. The current through each of the tubes that have been fired is interrupted at a 500-cycle per second rate but the relay that has been energized is unaffected by current interruptions at so high a rate.

The station identifying signals are sent through a channel which has a different frequency assignment than the ten message channels, and may, for example, be the lowest frequency multiplex channel. This may, for example, occupy the band from 280 to 500 cycles, this being the pass-band of the filters 70 and 75. Because of the use of steady frequency station identifying signals, this channel may be made much less sensitive to noise than the regular signaling channels so that it will not fail until transmission conditions become so poor that intelligible transmission of speech over the system become impossible. Alternatively, the station identifying transmission channel may be placed above the message channels in frequency. One protective feature already mentioned comprises the relay 80 for disabling the synthesizer when no recognizable identifying signal is received in the lowest frequency channel. A further protective feature is shown in FIG. 2 comprising the noise-operated protective circuit for operating the relay 110 when excessive noise is received through the station identifying channel. This relay is operated by a circuit which distinguishes between direct current control voltages on conductor 77 and rapidly varying voltages representing noise, sudden fades, etc. This circuit comprises a triode 111 having its grid connected to a point in the filtering circuit 100 for deriving control voltages therefrom. Amplifier 111 feeds into a fully wave rectifying circuit comprising valves 112, 113 which are connected to the control grid circuits of two opposed tubes 114 and 115. Relay 110 has its winding connected between the plates of the tubes 114 and 115. Slowly varying currents such as might normally occur in the input circuit 77 do not operate relay 110 since they have too little effect upon the tubes 114 and 115 or at least a nearly equal effect on these two tubes. Excessive alternating current components, however, produce differential effects in the tubes 114, 115 because of the separate rectification of opposite half waves of these currents. This produces unequal space currents in the tubes 114 and 115 with consequent operating current flowing in the winding of relay 110. Suitable smoothing circuits are shown between the rectifiers 112 and 113 and the tubes 114 and 115.

Two alternative circuits showing different ways of using relay 110 for protective purposes are indicated. First considering switches $S_1$, $S_2$, $S_3$ and $S_4$ in the positions shown, when the relay 110 becomes energized it short-circuits all of the control grid circuits of the stepper tubes 91 to 96 by connecting their grid input points directly to ground. Since these tubes are all prevented from firing, relay 80 remains deenergized and maintains the normal short-circuit across the synthesizer input. Second considering the switches $S_1$, $S_2$, $S_3$ and $S_4$ thrown to their alternate positions, the input grid lead for all of the stepper tubes is now shifted to conductor 117 leading to the grid of triode 120. By means of a cathode-follower type of coupling, the actuating voltages for the stepper are carried from tube 120, resistance 121, through $S_4$, and armature and normal contact of relay 110 to the grid of tube 123. A smoothing filter 122 is provided in this circuit, and a capacity 125 is connected across the grid circuit of tube 123. The input circuit for the stepper is completed from resistor 124 through $S_2$ to the grids of tubes 91 to 96.

So long as relay 110 is not operated, the input circuit to the stepper is closed through the back contact of the relay. When excessive noise or a deep fade causes relay 110 to operate, the stepper input circuit is interrupted but the particular relay 61 to 66 that is operated at this time remains operated by the charge on condenser 125 which maintains the control of the stepper the same until relay 110 releases and a new value of direct current, indicating a new key selection, is received.

In order to have maximum security it is desirable that the six keys obtainable by the relays have as little in common as possible. One requirement therefore is that in no two of them shall the same primary disk signal be connected to the same input lead of the coder. It is apparent that as many as nine keys meeting this requirement could be set up at a given time, if this many were desired. It is also apparent that among the factorial nine possible different ways of connecting the nine leads to the coder, many sets of nine combinations could be selected that would fulfull the above requirement. Not all the sets are equally desirable, however, as some of them would possess too simple a relationship between the different keys. The scheme disclosed makes available with a single set of connections a large number of the most desirable of the possible sets. It will be noted in connection with the wiring of the contacts of the selecting relays 61 to 66 that their armatures are connected to the conductors in group 53 in an irregular manner. This particular scheme of connection constitutes one feature of the invention which is highly advantageous. It was found by investigation that of all the possible permutations which meet the above stated requirement (that no two of the permutations shall result in connecting any lead in group 53 to the same lead in group 54), a relatively small number represent mere rotation within the group while a several-fold greater number represent other than simple rotation. A single set of selecting relays suffices to select any permutation in either one of these two classes exclusive of the other but a second set of relays would be necessary to select any permutation out of the total number of permutations of both classes. The maximum number selectable by the six relays 61 to 66 is obtained, therefore, by adopting a scheme of connection such that whatever be the order of arrangement of the input leads due to the patching used in panel 52, each relay when operated not only gives a different permutation from any other relay but the order of connection within the output leads 54 is other than that represented by mere rotation within the group. The scheme of connection shown in FIG. 2 meets these requirements and provides the greatest number of permutations obtainable of the required type by using as few as six relays.

The invention is not to be construed as limited to the specific disclosure but its scope is defined by the claims.

What is claimed is:

1. In a secret signaling system, means at a station for providing a plurality of different keys for use one at a time for enciphering signals to be sent from said station, means at said station when transmitting for sending a concomitant indication identifying the particular key that is in use in transmitting, means at a station when receiving secret signals and key indications from another station for providing a plurality of different keys which are duplicates of those provided at the distant sending station, means responsive to the received key indication for automatically selecting the appropriate key for deciphering the received secret signals, and means for deciphering said received secret signals by means of said selected key.

2. In a multistation secret signaling system, means for providing a plurality of different keys in duplicate at the several stations for use in enciphering and deciphering signals, means at a station when transmitting for selecting one of said keys, means to encipher outgoing signals from said station in accordance with the selected key, means for sending a concomitant signal for indentifying said selected key, means at a station when receiving for automatically selecting the key under control of said identifying signal and means at said latter station for deciphering the received enciphered signals by means of said automatically selected key.

3. In a secret signaling system, a receiving station for receiving secret communications from any one of a plurality of sending stations, means for also receiving key identifying signals from said stations, means for producing different secret keys for use in deciphering received secret communications, and means controlled by said key identifying signals for selecting the key to be used for deciphering the secret communication being received.

4. In a secret signaling system, a key pulse generating circuit comprising means to set up irregular series of pulses in each of a multiplicity of circuits, a coder for combining pulses from different ones of said circuits to build up a key wave, multipoint switches in said circuits for permuting said circuits among themselves as a group thereby feeding different combinations of pulses to said coder for producing different key waves, means to receive secret messages to be deciphered by means of a said key wave, means to receive key identifying signals, and means to actuate selectively said switches under control of said signals.

5. In a secret signaling system, a key pulse generator comprising means for setting up in each of a multiplicity of circuits different irregular series of pulses, a key producing circuit operated by said pulses for producing therefrom a key wave for deciphering received secret communication currents, code changing means, comprising a plurality of switches for altering the connections between said circuits and said key producing circuit, each switch when operated effecting a different scheme of connection of said circuits to said key producing circuit, and means responsive to received signals for selectively operating said switches to cause said key producing circuit to generate the proper key to enable decipherment of the secret communication currents being received.

6. The combination claimed in claim 5, in which said switches comprise relays each having a multiple number of armatures and contacts for closing individual circuit paths between said multiplicity of circuits and said key producing circuit, the armature of each relay closing said circuit paths in a different permutation such that no two permutations provided by the relays involve connection of the same circuit to the same point in said key producing circuit.

7. In a receiving system for the reception of secretly transmitted messages along with control currents, a key producing circuit having input and output terminals, pulse generators for supplying irregular series of pulses to said input terminals and switching circuits between said generators and input terminals for determining different orders of connection of said generators to said input terminals to cause said key producing circuit to form different keys for use in deciphering the secret messages, a plurality of multiple-contact switches, each when actuated connecting said generators to said input terminals in accordance with a different one of said orders and means for selectively actuating said switches under control of received control currents.

8. A receiving system according to claim 7 for communicating with any of several transmitting stations, in which a separate multiple-contact switch is provided for each such transmitting station, and a station-identifying signal operated from each switch.

9. In a receiving station for receiving secret messages from different transmitting stations using different secret keys, station identifying means at said receiving stations for identifying each of said transmitting stations, a key generator capable of producing each one of said different secret keys for use in deciphering secretly transmitted messages, selective switches for selecting the proper key for use in receiving from a given transmitting station, and means under control of said station identifying means for selectively acutating said switches in acccordance with the transmitting station from which the message is being received.

10. In a signaling system for transmitting signals with secrecy, a key producing system comprising a plurality of pulse generators and a plurality of circuits for variously modifying and mingling pulses from said generators to form keys for use in such secret transmission, switching points through which said circuits are carried, and means to produce and select different characteristic keys comprising means to close said switches to connect said circuits through said switching points in different permutations such that in no two permutations is the same pulse generator connected to the same circuit on the opposite side of the switching points.

11. In a key generating system, a plurality of pulse generators greater in number than two for generating pulses, a corresponding number of conductors, means connected with said conductors for variously using said pulses to build up final output pulses into a key, a switching point in said conductors including switches for variously permuting connections between all of the input conductors coming into said point and all of the output conductors going out from said point to produce different keys, each switch producing a different permutation from the others such that no two switches connect the same input conductor to the same output conductor and the order of connection of the output conductors in going through the whole plurality of conductors in succession taking any conductor as the first and progressing around to the last in the same direction is different for each switch.

12. A circuit for connecting N input leads, N being greater than three, simultaneously to N output leads in each of a number of different orders comprising a plurality of N-point switches each point of a switch when operated establishing connection between an individual input lead and an individual output lead, in which, with any assumed order of arrangement of the N input leads each switch when operated connects the N input leads to the N output leads in a different respective permutation and in which the order within the N output leads to which connection is so made differs from switch to switch when the order is taken progressively throughout the N output leads beginning with any chosen output lead and continuing throughout the N output leads around to the place of beginning.

* * * * *